US008079842B1

(12) United States Patent
Tomasic

(10) Patent No.: US 8,079,842 B1
(45) Date of Patent: Dec. 20, 2011

(54) PLASTER REMOVING DEVICE

(76) Inventor: Teo Tomasic, Briarwood, NY (US)

( * ) Notice: Subject to any disclaimer, the term of this patent is extended or adjusted under 35 U.S.C. 154(b) by 286 days.

(21) Appl. No.: 12/497,635

(22) Filed: Jul. 3, 2009

(51) Int. Cl.
*E04F 21/16* (2006.01)

(52) U.S. Cl. ... 425/173; 15/235.4; 15/235.8; 15/236.01; 425/182; 425/216; 425/458

(58) Field of Classification Search ..... 425/173, 425/182, 216, 458; 15/235.4, 235.7, 235.8, 15/236.01
See application file for complete search history.

(56) References Cited

U.S. PATENT DOCUMENTS

| | | | | |
|---|---|---|---|---|
| 849,681 | A * | 4/1907 | Hauver | 425/458 |
| 1,777,917 | A * | 10/1930 | Gretschel | 425/458 |
| 2,222,877 | A * | 11/1940 | Neal | 15/235.7 |
| 2,618,004 | A * | 11/1952 | Heyder | 15/236.01 |
| 4,810,128 | A * | 3/1989 | Kleinemas | 425/458 |
| 5,057,002 | A * | 10/1991 | Whited et al. | 425/458 |
| 5,352,113 | A * | 10/1994 | Alvarez | 425/458 |
| 6,257,856 | B1 * | 7/2001 | Stegmeier et al. | 425/458 |
| 2007/0061989 | A1 * | 3/2007 | Kalbach | 15/235.8 |

FOREIGN PATENT DOCUMENTS

GB 2074224 * 10/1981

* cited by examiner

*Primary Examiner* — James Mackey

(57) ABSTRACT

A plaster removing device includes a main device frame having first and second ends, a device trough carried by the main device frame and a plumb device carried by the main device frame.

7 Claims, 4 Drawing Sheets

PLASTER REMOVING DEVICE

FIELD OF THE INVENTION

The present disclosure relates to installation of crown molding and the like. More particularly, the present disclosure relates to a plaster removing device which is suitable for removing plaster from between crown molding and a ceiling after installation of the crown molding.

BACKGROUND

Crown molding is commonly used in residences and other buildings to enhance the aesthetic appearance of the junction between the ceiling and interior walls. The crown molding is typically nailed to the ceiling at the juncture of the ceiling with each wall. Plaster may first be applied between the crown molding and the ceiling to impart a seamless appearance between the crown molding and the ceiling. However, when the crown molding is pushed against the ceiling, the plaster is typically forced out from between the crown molding and the ceiling and should be removed from the gap between the crown molding and the ceiling before the plaster dries.

SUMMARY OF THE INVENTION

The present disclosure is generally directed to a plaster removing device. An illustrative embodiment of the plaster removing device includes a main device frame having first and second ends, a device trough carried by the main device frame and a plumb device carried by the main device frame.

BRIEF DESCRIPTION OF THE DRAWINGS

The disclosure will now be made, by way of example, with reference to the accompanying drawings, in which.

DETAILED DESCRIPTION

Figure 1:
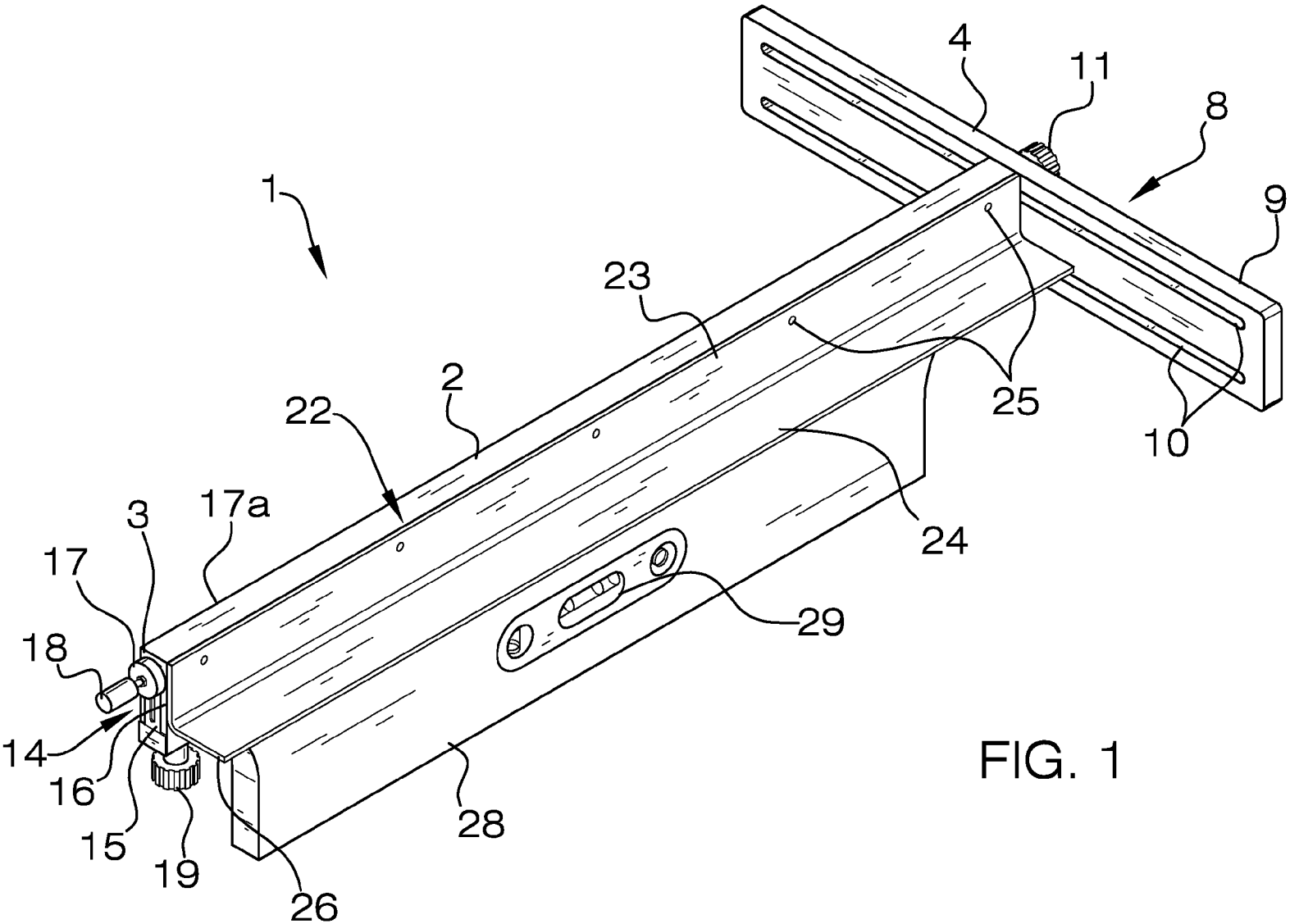
FIG. 1 is a right side perspective view of an illustrative embodiment of the plaster removing device.
Figure 2:
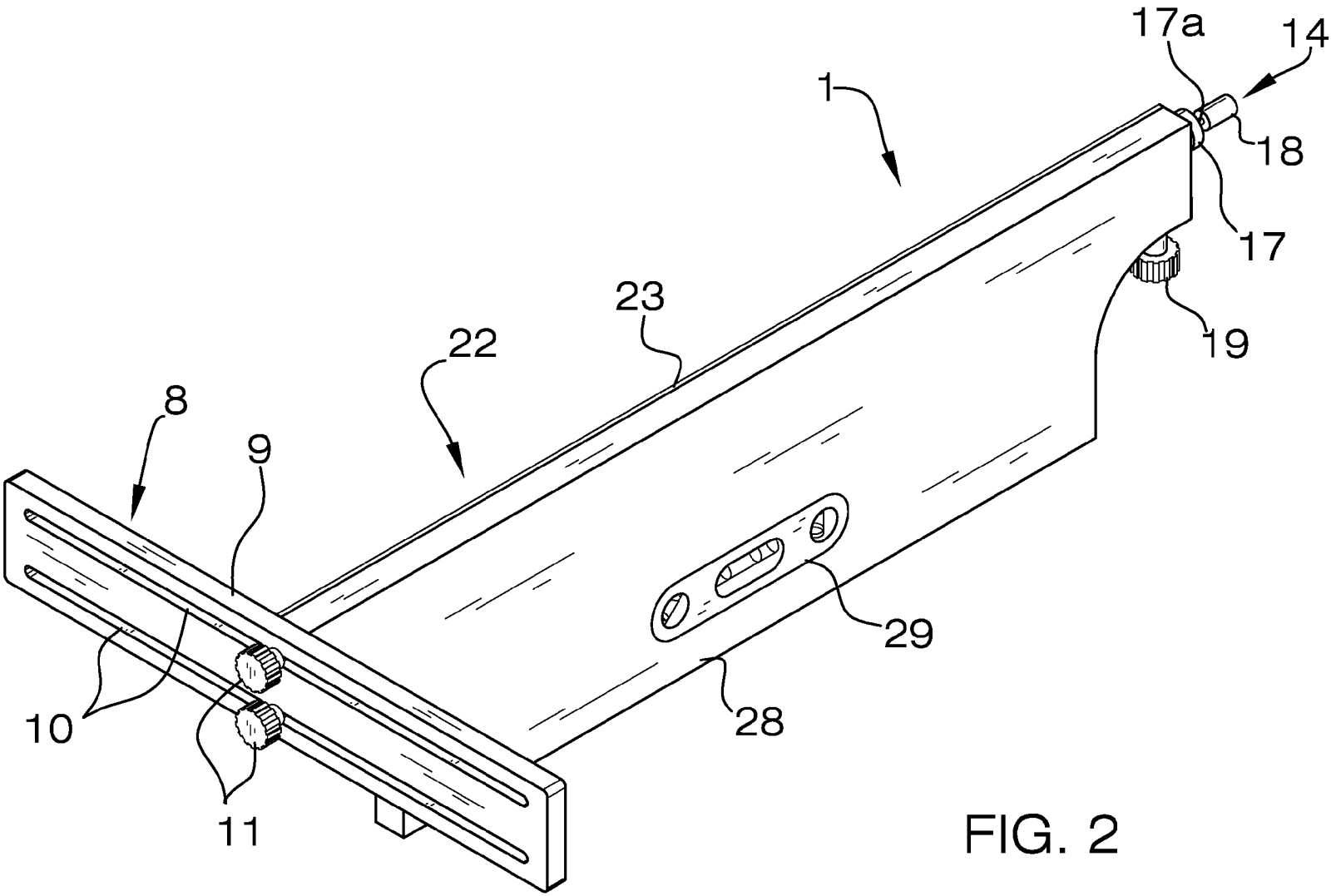
FIG. 2 is a left side perspective view of an illustrative embodiment of the plaster removing device.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Referring to the drawings, an illustrative embodiment of the plaster removing device is generally indicated by reference numeral 1. The plaster removing device 1 includes a main device frame 2 which in some embodiments may have a generally elongated, rectangular shape. The main device frame 2 may have a first end 3 and a second end 4 which is opposite the first end 3. A device handle 28, which may be generally elongated, may be provided on a bottom surface (not shown) of the main device frame 2. In some embodiments, a level 29 may be provided on the device handle 28.

Figure 3:
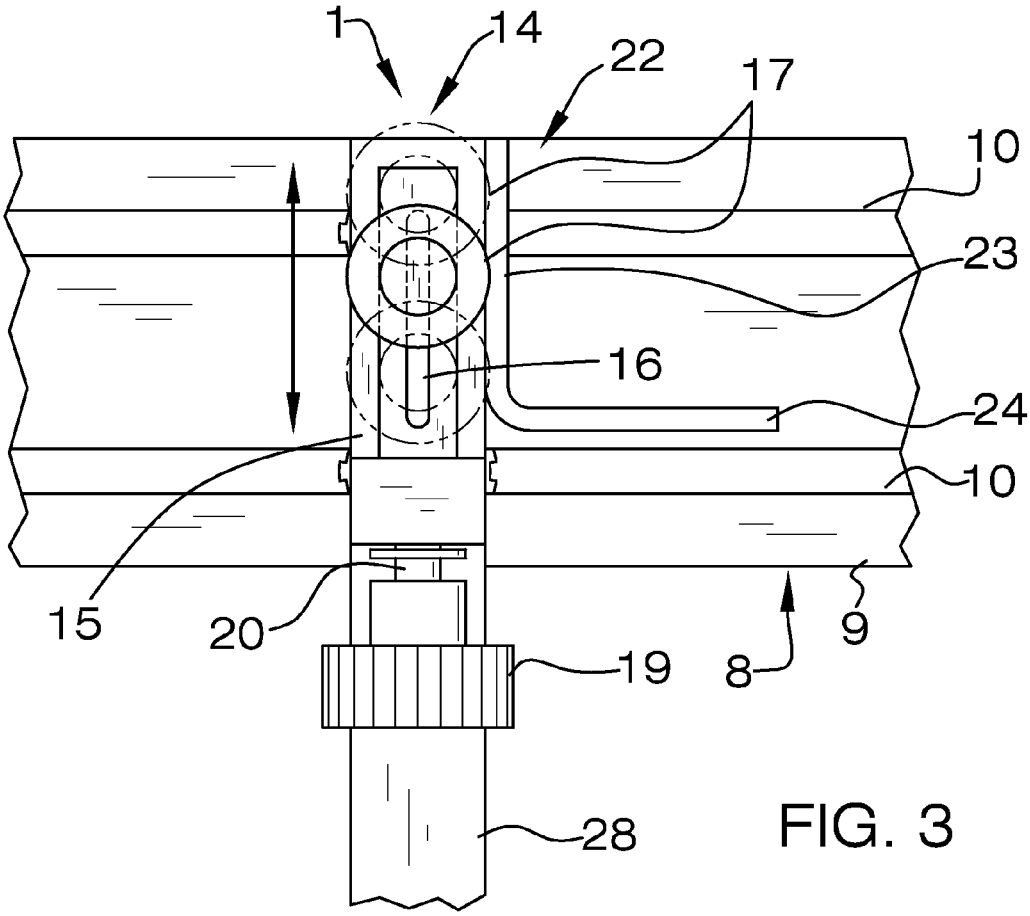
FIG. 3 is a side view of a roller assembly of an illustrative embodiment of the plaster removing device (partially in section), more particularly illustrating adjustment of the roller assembly.
Figure 5:
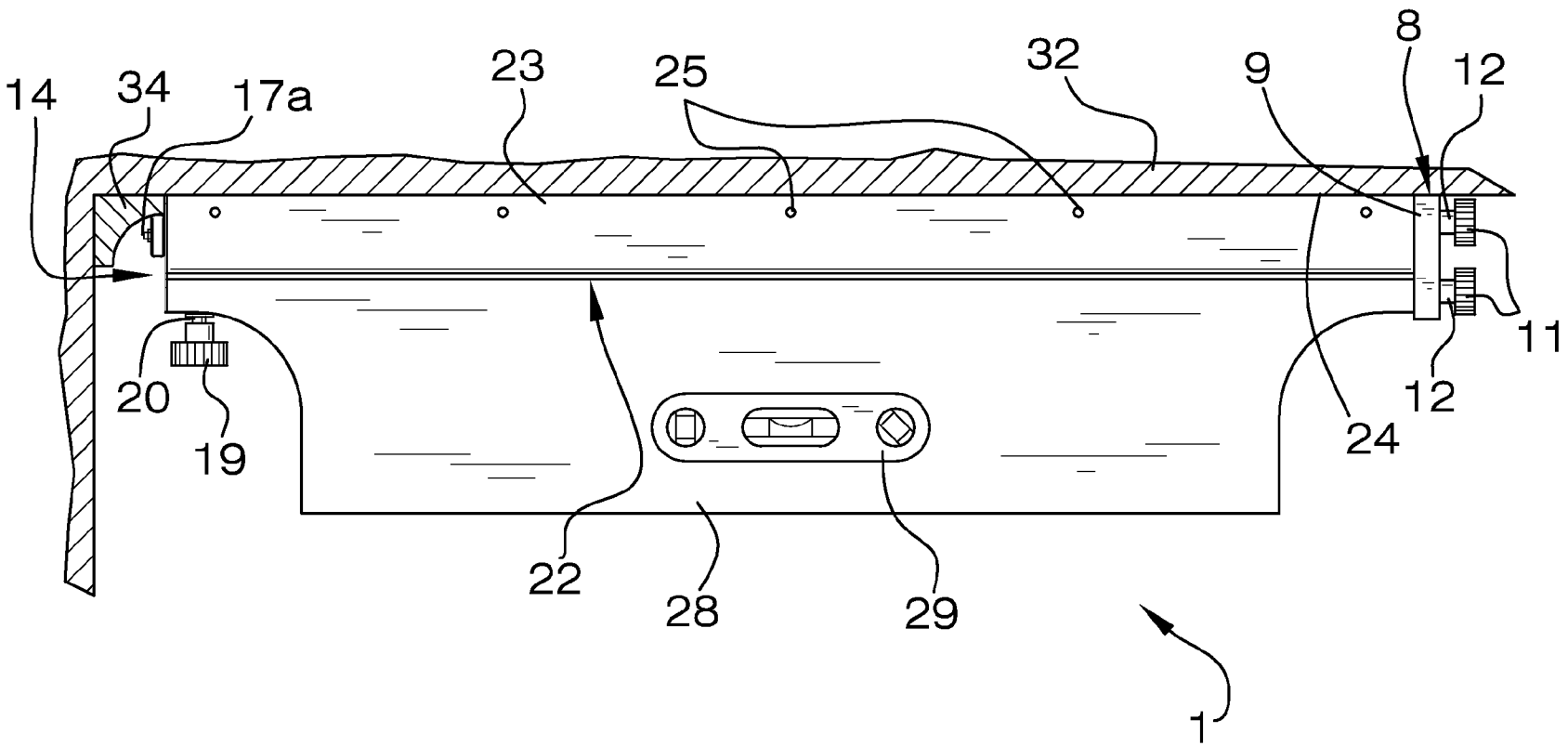
FIG. 5 is a front view of an illustrative embodiment of the plaster removing device, placed against a ceiling and crown molding in the removal of plaster from between the ceiling and crown molding.

A roller assembly 14 may be provided on the first end 3 of the main device frame 2. The roller assembly 14 may include a roller bracket 15 which is provided on the first end 3 of the main device frame 2. An elongated bracket slot 16 may be provided in the roller bracket 15. An adjusting roller 17 may be provided on a roller shaft 17*a* which is adjustably and slidably mounted in the bracket slot 16. A roller handle 18 may extend from the adjusting roller 17. The adjusting roller 17 may be mounted for selective adjustment along the bracket slot 16 of the roller bracket 15 according to any suitable technique which is known by those skilled in the art. As shown in FIGS. 3 and 5, in some embodiments a roller adjustment knob 19 has a knob shaft 20 (FIG. 5) which threadably engages a knob opening (not shown) provided in the main device frame 2. The knob shaft 20 abuts against the roller shaft 17*a* of the adjustment roller 17 to facilitate selective positioning of the roller shaft 17*a* and roller adjustment knob 19 along the bracket slot 16.

Figure 4:
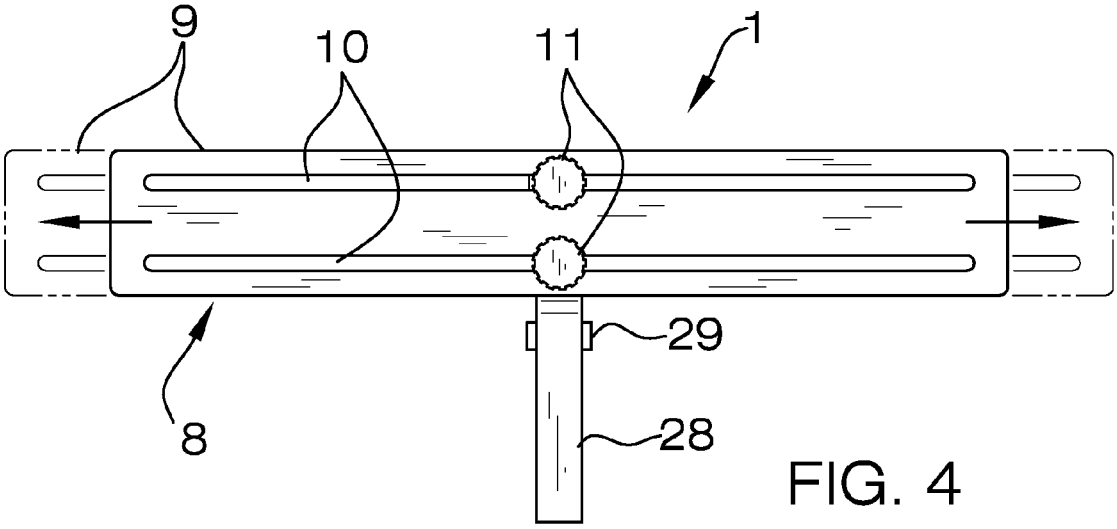
FIG. 4 is a side view of a plumb device of an illustrative embodiment of the plaster removing device.

A plumb device 8 may be provided on the second end 4 of the main device frame 2. The plumb device 8 may include a generally elongated, rectangular plumb device frame 9 which may be disposed in generally perpendicular relationship with respect to the main device frame 2. A pair of generally elongated, parallel, spaced-apart frame slots 10 may extend through the plumb device frame 9. A pair of frame adjustment knobs 11 may be provided on respective knob shafts 12 (FIG. 5) which extend through the respective frame slots 10 and are threaded into a pair of respective shaft openings (not shown) provided in the second end 4 of the main device frame 2. Accordingly, the frame adjustment knobs 11 may be selectively loosened to facilitate selective fore and aft adjustment of the plumb device 8 on the main frame 2, as shown in FIG. 4 and then re-tightened to secure the plumb device 8 at the desired position with respect to the main frame 2.

A device trough 22 may be provided on the main device frame 2 of the plaster removing device 1. The device trough 22 has a trough end 26 which generally coincides positionally with the first end 3 of the main device frame 2. In some embodiments, the device trough 22 may be generally coextensive with the main device frame 2. The device trough 22 may have a generally L-shaped configuration with an attachment portion 23 which is provided on a front surface (not numbered) of the main device frame 2 and a blade 24 which extends outwardly from the attachment portion 23 in generally perpendicular relationship thereto. The device trough 22 may be attached to the main device frame 2 according to any suitable technique which is known by those skilled in the art. In some embodiments, fasteners 25 may be extended through respective fastener openings (not shown) provided in the attachment portion 23 and into respective fastener openings (not shown) provided in the main device frame 2.

As shown in FIG. 5, in typical application the plaster removing device 1 is used to remove excess plaster (not shown) from between a strip of crown molding 34 and a ceiling 32 after application of the plaster between the crown molding 34 and the ceiling 32. Accordingly, the handle 28 may be grasped as the main device frame 2 and the plumb device 8 are placed flat against the ceiling 32. The upper corner of the attachment portion 23 of the device trough 22 is placed in the gap between the ceiling 32 and the crown molding 34 as the adjusting roller 17 of the roller assembly 14 is placed against the lower surface of the crown molding 34. The vertical position of the adjusting roller 17 of the roller assembly 14 may first be adjusted such as by using the roller adjustment knob 19, as was heretofore described with respect to FIG. 3. Accordingly, the position of the adjusting roller 17 along the bracket slot 16 (FIG. 1) of the roller bracket 15 depends on the thickness of the crown molding 34 and is selected such that the adjusting roller 17 engages the crown molding 34 while the main device frame 2 and the upper edge of the attachment portion 23 of the device trough 22 lie flat against the ceiling 32. The level 29 on the device handle 28 indicates whether or not the plaster removing device 1 is level against the ceiling 32.

Next, the plaster removing device 1 is moved along the surface of the ceiling 32 and the adjusting roller 17 of the roller assembly 14 rolls along the lower surface of the crown molding 34. Accordingly, the attachment portion 23 of the device trough 22 scrapes the plaster from the gap between the ceiling 32 and the crown molding 34 and falls onto the blade portion 24 of the device trough 22. The scrapped plaster collects on the blade portion 24 of the device trough 22 and can be subsequently removed therefrom after the plaster removing device 1 is lowered from the ceiling 32. As the plaster is removed from between the ceiling 32 and the crown molding 34, a seamless appearance is left between the crown molding 34 and the ceiling 32.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A plaster removing device, comprising:

a main device frame having first and second ends;

a device trough carried by said main device frame;

a plumb device carried by said main device frame;

a roller assembly having an adjusting roller carried by said first end of said main device frame, said adjusting roller is adjustably mounted on said main device frame;

said roller assembly comprises a roller bracket carried by said first end of said main device frame and wherein said adjusting roller is adjustably carried by said roller bracket; and a bracket slot provided in said roller bracket and a roller shaft extending through said bracket slot, and wherein said adjusting roller is carried by said roller shaft.

2. The plaster removing device of claim 1 wherein said plumb device comprises a generally elongated plumb device frame carried by said second end of said main device frame.

3. The plaster removing device of claim 2 wherein said plumb device frame is generally perpendicular with respect to said main device frame.

4. The plaster removing device of claim 1 further comprising a device handle and wherein said main device frame is carried by said device handle.

5. The plaster removing device of claim 4 further comprising a level carried by said device handle.

6. A plaster removing device, comprising:

a device handle;

a generally elongated, rectangular main device frame having first and second ends carried by said device handle;

a level carried by said device handle;

a device trough having an attachment portion carried by said main device frame and a blade portion carried by said attachment portion in generally perpendicular relationship with respect to said attachment portion, said device trough having a trough end generally corresponding positionally to said first end of said main device frame;

a plumb device having a generally elongated plumb device frame carried by said second end of said main device frame and disposed in generally perpendicular relationship with respect to said main device frame; and a roller assembly comprising:

a roller bracket having a bracket slot carried by said first end of said main device frame;

a roller shaft extending through said bracket slot;

an adjusting roller carried by said roller shaft;

a knob shaft threadably engaging said main device frame and engaging said roller shaft; and a roller adjustment knob carried by said knob shaft.

7. The plaster removing device of claim 6 further comprising a roller handle carried by said roller shaft.

* * * * *